US008305401B1

(12) United States Patent
Lie

(10) Patent No.: US 8,305,401 B1
(45) Date of Patent: Nov. 6, 2012

(54) DIGITAL LIGHT MANAGEMENT CONTROLLER

(75) Inventor: Henrik Lie, Gistrup (DK)

(73) Assignee: Maxim Integrated, Inc., San Jose, CA (US)

( * ) Notice: Subject to any disclaimer, the term of this patent is extended or adjusted under 35 U.S.C. 154(b) by 792 days.

(21) Appl. No.: 12/430,811

(22) Filed: Apr. 27, 2009

(51) Int. Cl.
*G09G 5/10* (2006.01)

(52) U.S. Cl. ..... 345/690; 345/77

(58) Field of Classification Search ..... 315/291, 315/307–308; 345/77, 102, 204, 690
See application file for complete search history.

(56) References Cited

U.S. PATENT DOCUMENTS

| | | | | |
|---|---|---|---|---|
| 4,566,134 | A | 1/1986 | Harbour et al. | |
| 5,384,516 | A | 1/1995 | Kawabata et al. | |
| 5,736,881 | A | 4/1998 | Ortiz | |
| 5,767,631 | A | 6/1998 | Konopka et al. | |
| 5,956,014 | A * | 9/1999 | Kuriyama et al. | 345/690 |
| 6,388,388 | B1 * | 5/2002 | Weindorf et al. | 315/169.3 |
| 6,392,358 | B1 | 5/2002 | Runau et al. | |
| 6,697,402 | B2 | 2/2004 | Crawford | |
| 6,798,372 | B1 | 9/2004 | Yang et al. | |
| 6,807,209 | B2 | 10/2004 | Martinez et al. | |
| 6,841,947 | B2 * | 1/2005 | Berg-johansen | 315/169.3 |
| 6,859,473 | B1 | 2/2005 | Tan | |
| 6,987,787 | B1 * | 1/2006 | Mick | 372/29.021 |
| 7,332,877 | B2 * | 2/2008 | Crodian et al. | 315/297 |
| 7,439,945 | B1 | 10/2008 | Awalt et al. | |
| 7,545,369 | B1 | 6/2009 | Lan et al. | |
| 2002/0130786 | A1 * | 9/2002 | Weindorf | 340/815.45 |
| 2003/0016711 | A1 | 1/2003 | Crawford | |
| 2004/0036990 | A1 | 2/2004 | Hanano | |
| 2004/0071210 | A1 * | 4/2004 | Amara et al. | 375/240.01 |
| 2005/0073263 | A1 | 4/2005 | Havlik et al. | |
| 2005/0156536 | A1 | 7/2005 | Ball | |
| 2005/0162098 | A1 | 7/2005 | Ball | |
| 2005/0243022 | A1 | 11/2005 | Negru | |
| 2007/0164686 | A1 | 7/2007 | Ribarich et al. | |
| 2007/0257623 | A1 | 11/2007 | Johnson et al. | |
| 2007/0262724 | A1 | 11/2007 | Mednik et al. | |
| 2008/0031014 | A1 | 2/2008 | Young | |
| 2008/0117649 | A1 | 5/2008 | Tanaka et al. | |
| 2009/0033685 | A1 * | 2/2009 | Park et al. | 345/690 |
| 2010/0315572 | A1 | 12/2010 | LoCascio | |

OTHER PUBLICATIONS

Non-Final Office Action dated Aug. 30, 2010, U.S. Appl. No. 11/767,400, filed Jun. 22, 2007, Mehmet Nalbant.

(Continued)

*Primary Examiner* — Amare Mengistu
*Assistant Examiner* — Stacy Khoo
(74) *Attorney, Agent, or Firm* — North Weber & Baugh LLP

(57) ABSTRACT

A light management unit (LMU) includes multiple brightness compensation modules and algorithms mixed together in a digital domain. The LMU is configured to receive content data, such as gamma correction data generated by a graphics or video processor and corresponding to frames of video data, ambient light data obtained using a light sensor, ambient temperature data using a temperature sensor, and a manual brightness setting. An ambient light compensation value is multiplied into the manual brightness settings so the resulting compensation value is a percent of the manual settings. A content adjustment interface (CAI) module is configured to compensate the backlight brightness according to real-time video data. The content adjustment performed by the CAI module is combined with the ambient light adaptive dimming. A final stage step generator enables a gradual brightness transition to minimize, if not eliminate jitter and jump.

25 Claims, 3 Drawing Sheets

OTHER PUBLICATIONS

Final Office Action dated Nov. 22, 2011, U.S. Appl. No. 11/767,400, filed Jun. 22, 2007, Mehmet Nalbant.

Notice of Allowance dated Feb. 7, 2012, U.S. Appl. No. 11/767,400, filed Jun. 22, 2007, Mehmet Nalbant.

* cited by examiner

DIGITAL LIGHT MANAGEMENT CONTROLLER

FIELD OF THE INVENTION

The present invention relates to the field of display devices. More particularly, the present invention relates to the field of controlling the backlight applied to a display screen within a mobile device.

BACKGROUND OF THE INVENTION

The use of mobile devices, and the amount of time that mobile device are in use, continues to increase. As such, power requirements of mobile devices are a significant issue, and the reduction of power consumption in mobile devices is a common design consideration. The power consumption of liquid crystal displays (LCDs) used in many mobile devices typically ranges from 20% to 30% of the total system power. For video images, or frames, that have few or no bright pixels, all pixels of these images can be amplified without introducing any visible artefacts. This procedure increases the perceived contrast and brightness of the corresponding image, the extra brightness of the applied video gain can be compensated by reducing the brightness of the backlight. Gamma correction is used for compensating the dynamic range. However, strong gamma correction leads to substantial loss of contrast and color. One of the well known weakness of LCD's it the capability to reproduce black color. True black gives each color greater definition and creates a far greater number of shades, more depth, and a sharper detail level. By additionally reducing the backlight together with additional gamma correction control an enhancement of the black color is achieved.

Another method of increasing the dynamic range of the display and achieving power savings is automatic brightness control of the backlight based upon ambient light conditions. A sensor measures the ambient light and the backlight is adjusted accordingly. When there is less ambient light the maximum output power of the backlight is reduced, thereby saving power. To save battery life, the backlight is operated at as low a power level as possible. However, this results in insufficient dynamic range in all environments except in very dark environments. Using ambient light compensation, the backlight brightness is changed based on ambient light conditions. This ensures that regardless of ambient light conditions the dynamic range is maintained at a sufficient level.

Conventional light management controllers or LED drivers are only able to effectively handle compensation of either gamma correction or ambient light compensation at a given time. If the light management simultaneously compensates for both gamma correction and ambient light, it is typically achieved by splitting up the compensation into a few discrete steps that result in a poor user experience, higher distortion of the image, and reduced power saving.

SUMMARY OF THE INVENTION

A light management unit (LMU) provides improved power efficiency and control of multiple backlight functions. The LMU includes multiple compensation modules and algorithms mixed together in a digital domain. Data used by the compensation modules and algorithms is provided via an input bus or by default settings. The LMU controls the display brightness via ambient light conditions, image content adjustment, ambient temperature compensation, and physiologic brightness control. Implementation of the LMU provides a power savings and also contributes to dynamic contrast, as the light leakage through the dark area of an image can be reduced. A final stage step generator enables a gradual brightness transition to minimize, if not eliminate, jitter and jump.

A content compensation module is configured to compensate the backlight brightness according to the related video data. The content compensation module receives gamma correction data from a graphics processing module. In some embodiments, the gamma correction data is in a pulse width modulation (PWM) format and is decoded to N-bit parallel data. In an exemplary application, the gamma correction data is decoded to 8-bit parallel data. The gamma correction data is provided in real-time, and therefore the content compensation is also generated in real-time. To avoid noise and flicker in the backlight, a step generator is coupled to the output of the content compensation module to increment or decrement the display drive current in micro steps until the output from the content compensation module matches the output display drive current.

To further adjust the power consumption, the content adjustment performed by the content compensation module is combined with ambient light adaptive dimming. Ambient light data is obtained using an ambient light sensor. When there is a relatively small amount of ambient light, the output power of the backlight is reduced. When there is a relatively large amount of ambient light, the output power of the backlight is increased. In some embodiments, the ambient light is split up into X different ranges, where the ambient light compensation calculated for each range provides a unique shape and gain factor. In other embodiments, a single ambient light compensation value is calculated. The ambient light compensation value is then multiplied into the manual brightness settings so the resulting compensation value is a percent of the manual settings.

The LMU is designed to match visual characteristics of the human eye. The eye can adapt to increased darkness, for example going from a bright environment to a dark environment, or increased lightness, going from a dark environment to a light environment. Each of these adaptations comes in two varieties, a slow phase adaptation and a transient phase adaptation. The slow phase adaptation typical takes 45 minutes to complete, and the transient phase adaption takes only seconds. Controlling the ambient light compensation to account for theses human eye visual characteristics is enabled by a step counter. The step counter provides an automatic speed control for changing the ambient light compensation, which implements a rate of change depending of the ambient light magnitude. If the ambient light changes from dark to bright light, for example, the backlight compensation is implemented quickly to maintain a good contrast. The direction of a change in the ambient light is also calculated so that the step counter can be incremented or decremented accordingly. The rate of change, or step time, implemented by the step counter is programmable via a bus. In some embodiments, the step time is defined as the slope of a function. The slope defines a specific rate of change implemented by the step counter.

The LMU is configured to receive content data, such as gamma correction data corresponding to frames of video data, ambient light data, ambient temperature data, and a manual brightness setting. The gamma correction data is generated by a graphics or video processor, the ambient light data is provided by an ambient light sensor, and the ambient temperature data is provided by a temperature sensor. The manual brightness setting is a default setting or is set by a user.

BRIEF DESCRIPTION OF THE DRAWINGS

Embodiments of the light management unit are described relative to the several views of the drawings. Where appropriate and only where identical elements are disclosed and shown in more than one drawing, the same reference numeral will be used to represent such identical elements.

DETAILED DESCRIPTION OF THE EMBODIMENTS

Figure 1:
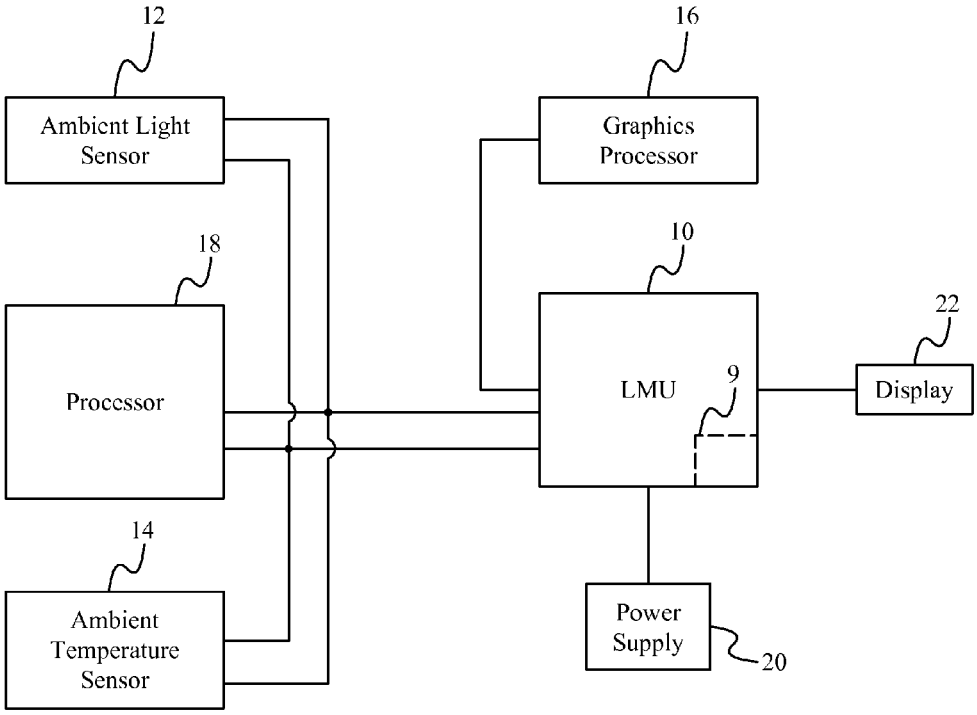
FIG. 1 illustrates a block diagram of an exemplary circuit for implementing the LMU.

Reference will now be made in detail to the embodiments of the light management unit of the invention, examples of which are illustrated in the accompanying drawings. While the invention will be described in conjunction with the embodiments below, it will be understood that they are not intended to limit the invention to these embodiments and examples. On the contrary, the invention is intended to cover alternatives, modifications and equivalents, which may be included within the spirit and scope of the invention as defined by the appended claims. Furthermore, in the following detailed description of the present invention, numerous specific details are set forth in order to more fully illustrate the present invention. However, it will be apparent to one of ordinary skill in the prior art that the present invention may be practiced without these specific details. In other instances, well-known methods and procedures, components and processes haven not been described in detail so as not to unnecessarily obscure aspects of the present invention.

In accordance with the present application, some of the components, process steps, and/or data structures may be implemented using various types of processing systems, including hardware, software, or any combination thereof. In addition, those of ordinary skill in the art will recognize that devices of a less general purpose nature, such as hardwired devices, application specific integrated circuits (ASICs), or the like, may also be used without departing from the scope and spirit of the inventive concepts disclosed herein.

Embodiments of the light management unit (LMU) include an ambient light compensation module, an ambient temperature compensation module, a content compensation module, a step counter, and a step generator. The ambient light compensation module receives as input a digitally converted ambient light signal and a digital manual brightness value. The ambient light compensation module calculates an ambient light compensation value. The step counter receives the ambient light compensation value and compares the ambient light compensation value to an ambient light compensation value from a previous cycle. If the current ambient light compensation value is different than the previous ambient light compensation value, then the current ambient light compensation value is stepped up or down, depending on the result of the comparison, to generate a first brightness value. The step amount is a programmable value. The ambient temperature compensation module receives as input a digitally converted ambient temperature signal and the first brightness value. The ambient temperature compensation module modifies the first brightness value according to the ambient temperature signal, thereby generating a second brightness value.

The content compensation module receives gamma correction data corresponding to frames of video data. The gamma correction data includes a frame brightness value for each frame of video data. The frame brightness value corresponds to a duty-cycle for the frame of video data. In some embodiments, the gamma correction data is a PWM signal with a modulation of 0 to 100% duty cycle. The content compensation module includes a binary counter and the PWM signal is over-sampled to determine the corresponding duty cycle. The value of the duty cycle is greater than or equal to zero and less than or equal to one. The content compensation module multiplies the second brightness value received from the ambient temperature compensation module by the duty cycle. The result is a third brightness value.

The step generator includes a counter and a comparator. The value of the counter is output as a current applied brightness value. The counter is incremented or decremented according to a result output from the comparator. The comparator compares the third brightness value received from the content compensation module during a current cycle with a third brightness value received from the previous cycle. If the current third brightness value is greater than the current applied brightness value, then the counter is incremented, thereby increasing the applied brightness value. If the current third brightness value is less than the current applied brightness value, then the counter is decremented, thereby decreasing the applied brightness value. If the current third brightness value is the same as the current applied brightness value, then the counter is unchanged.

FIG. 1 illustrates a block diagram of an exemplary circuit for implementing the LMU. An LMU 10 is coupled to an ambient light sensor 12 to receive an analog ambient light signal, to an ambient temperature sensor 14 to receive an analog temperature signal, and to a graphics or video processor 16 to receive gamma correction data according to frames of video data. A baseband processor or controller 18 and a power supply 20 are also coupled to the LMU 10. A display device 22 is coupled to an output of the LMU 10 to receive a display driver signal. In some embodiments, the LMU 10 includes a display device driver 9 that receives a generated applied brightness value and outputs the display device driver signal. In other embodiments, an external display device driver is coupled to the LMU 10, and the LMU 10 outputs the applied brightness value to the display device driver, which in turn generates the display driver signal.

Figure 2:
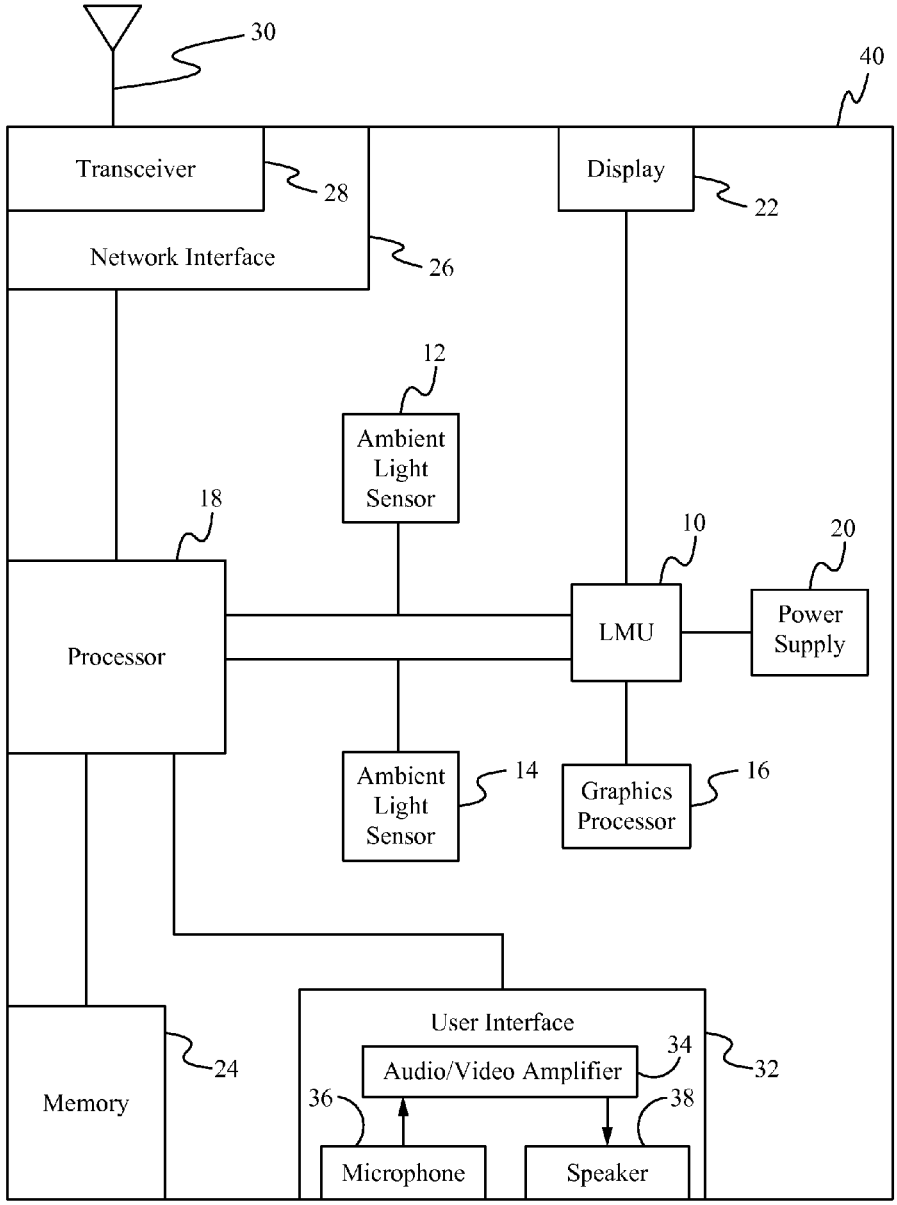
FIG. 2 illustrates a simplified high-value block diagram of an exemplary application of the LMU within a mobile communication device.

FIG. 2 illustrates a simplified high-value block diagram of an exemplary application of the LMU within a mobile communication device. The mobile communication device includes the LMU 10, the ambient light sensor 12, the ambient temperature sensor 14, the graphics or video processor 16, the processor 18, the power supply 20 and the display 22 of FIG. 1. The mobile communication device 10 also includes an antenna 30 coupled to a transceiver 28 within a network interface module 26. The network interface module 26, a memory 24, and a user interface 32 are coupled to the processor 18. The user interface includes a microphone 36 and a speaker 38 coupled to an audio/video amplifier 34. It is understood that the LMU of the present invention can be implemented in any conventional mobile device that utilizes a display.

Figure 3:
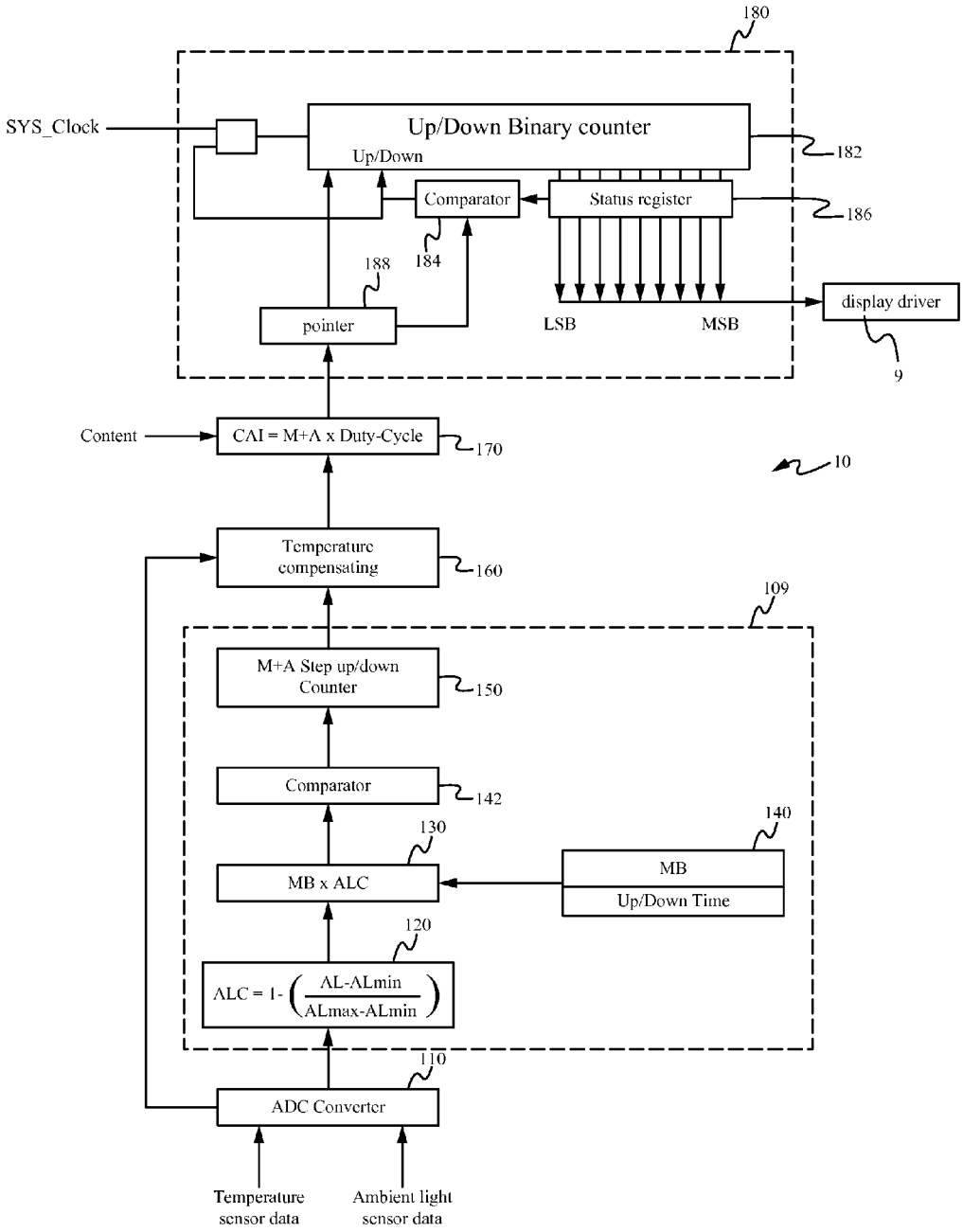
FIG. 3 illustrates a block diagram of the LMU according to an embodiment of the present invention.

FIG. 3 illustrates a block diagram of the LMU according to an embodiment of the present invention. The LMU 10 includes an analog-to-digital converter 110, a temperature compensation module 160, a content compensation module 170, a step generator 180, and an ambient light compensation module 109. The ambient light compensation module 109 includes an arithmetic logic unit 120, a memory 140, a multiplier 130, a comparator 142, and a step counter 150. The memory 140 receives a manual brightness setting (MB), the analog-to-digital converter 110 receives analog ambient light sensor data, the temperature compensation module 160 receives ambient temperature sensor data, and the content compensation module 170 receives gamma correction data.

An analog ambient light signal is converted to a digital ambient light signal by the analog-to-digital converter 110. The digital ambient light signal (AL) is input to the ALU 120, which scales the digital ambient light signal to be a percent of the total dynamic range. The total dynamic range is defined by the difference between a set ambient light maximum (ALmax) and a set ambient light minimum (ALmin), which are both programmable values. The ALU 120 outputs a scaled ambient light value, also referred to as an ambient light compensation (ALC) value, to the multiplier 130. The ALC value is calculated according to:

$$ALC=(1-(AL-AL\text{min})/(AL\text{max}-AL\text{min})).$$

The multiplier 130 multiples the ALC value by a desired brightness value, stored as the manual brightness (MB) value in the memory 140. The manual brightness value is either set by a user or is a default setting. The output of the multiplier 130 is referred to as an M+A value, which is the desired output brightness value compensated according to the ambient light.

The step counter 150 functions as a synchronizing step that passes through the M+A value according to a step time. The step time is programmable, and can change according to a defined slope, such as a slope corresponding to a linear or logarithmic function. The step counter 150 is enabled when the difference between the current value of M+A is different than a previously calculated M+A value. The M+A value of a current cycle is output from the multiplier 130 to a comparator 142. The comparator 142 compares the current M+A value with the M+A value of the previous cycle stored in the step counter 150. If the two values are the same, then the M+A value stored in the step counter 150 is output to the temperature compensation module 160. If there is a difference between the two values, the M+A value stored in the step counter is incremented or decremented according to the comparison. If the M+A value output from the multiplier 130 is larger, then the step counter is incremented. If the M+A value output from the multiplier 130 is smaller, then the step counter is decremented. The M+A value is output from the step counter 150 to the temperature compensation module 160 during a next clock cycle. The step time is the time between incrementing or decrementing the step counter. In some embodiments, the step time is defined according to specific ambient light magnitudes, direction of ambient light change, and the absolute rate of ambient light change. The step counter is incremented or decremented once per step time. The step time can be implemented as the slope of a defined function, such as a linear or logarithm function. The slope is the rate of change implemented by the step counter. The step time is programmable and can change with different slopes of the defining function.

The analog ambient temperature signal is converted to a digital ambient temperature signal by the analog-to-digital converter 110. The digital ambient temperature signal is input from the analog-to-digital converter 110 to the temperature compensation module 160. The M+A value output from the step counter 150 is also input to the temperature compensation module 160, which adjusts the input M+A value according to the input ambient temperature signal. In some embodiments, the brightness of a display, such as an LED, changes as a function of the ambient temperature. Using the temperature compensation module 160 to compensate the M+A value according to the ambient temperature provides uniform brightness across the ambient temperature range. The temperature compensation function can also be used to adjust the current drive provided to the display at high ambient temperature, preventing the display from being damaged. The temperature compensation module 160 multiplies the input M+A value by a temperature compensation value, thereby scaling the temperature compensation value based on the manual brightness setting and the ambient light condition. The output of the temperature compensation module 160 is an adjusted M+A value, which is the desired output brightness value compensated according to the ambient light and the ambient temperature.

In some embodiments, the temperature characteristics of the display are programmed into the temperature compensation module 160. In an exemplary application, the temperature compensation module 160 includes three registers to define three temperature compensation values. Each of the three temperature compensation values is applied to one of three ambient temperature ranges. The input ambient temperature data is compared with the three temperature ranges, and the appropriate temperature compensation value is selected from one of the three registers. It is understood that more or less than three registers and three temperature ranges can be used.

The adjusted M+A value output from the temperature compensation module 160 is input to the content compensation module 170. The content compensation module 170 also receives as input gamma correction data. The gamma correction data includes a frame brightness value corresponding to each frame in the video data. In some embodiments, the gamma correction data is a PWM signal converted to a binary number, and a duty cycle of the PWM signal is calculated prior to the content compensation module 170. The duty cycle defines the frame brightness value. The content compensation module 170 multiples the duty cycle by the temperature adjusted M+A value received from the temperature compensation module 160, resulting in a content compensated brightness value. The content compensation module 170 outputs the content compensated brightness value to the step generator 180. The content adjustment data is synchronous with the current video frame. Using content compensation, the LMU is adaptive to scene content, so that frame images are well balanced to the display, whether the frame images include dark, bright, or mixed content.

The step generator 180 defines the slew-rate of the drive current applied to the display. The compensated brightness value output from the content compensation module 170 is compared by the comparator 184 to the brightness value currently applied to the display, referred to as the applied brightness value. The applied brightness value is stored in the register 186. If the compensated brightness value is greater than the applied brightness value, then the counter 182 is incremented and the incremented counter value is moved to the register 186 as the new applied brightness value. If the compensated brightness value is less than the applied brightness value, then the counter 182 is decremented and the decremented counter value is moved to the register 186 as the new applied brightness value. If the compensated brightness value is equal to the applied brightness value, then the counter 182 and the applied brightness value in the register 186 are unchanged. The step generator 180 minimizes, if not prevents, jumps in the applied brightness value if there is a relatively large difference between the new output value and the existing value. When a change in the applied brightness value is required, the step generator increments/decrements at a speed of the clock. An advantage of the step generator is that the input compensated brightness level does not need to be synchronous with the rest of the LMU, and the ramp up/down of the applied brightness value is smooth, without noise and flicker. The step generator 180 operates at high speed and the corresponding step adjustments are not visible to the human eye and does not introduce relevant delay to the content adjustment.

In some embodiments, the LMU includes a high efficiency step-up converter that provides the supply voltage to the output display devices. In an exemplary application, the converter is designed to operate from an input voltage range of 2.7V to 5.5V and supply an output voltage up to 28V. For improved high efficiency, the step-up converter can be configured to automatically shift from PWM to pulse-skipping mode at light loads. The output voltage can be automatically adjusted to minimize the voltage drop over the load and the final stage step generator provides minimum power dissipation.

The order of operation of the LMU is described above as first performing the ambient light compensation and then performing the ambient temperature compensation. Alternatively, the ambient light compensation step can be reversed with the ambient temperature compensation step. In this alternative configuration, an ambient temperature compensation value is determined according to the digital ambient temperature signal. The temperature compensation value is then multiplied by the ambient light compensation (ALC) value, which in turn is multiplied by the manual brightness setting. The resulting ambient light and ambient temperature compensated value is then compared to a similar value calculated for the previous cycle. The step counter is similarly applied to this comparison as to the comparison performed by the comparator 142 described in relation to FIG. 3. The output of the step counter is the adjusted M+A value input to the content compensation module 170.

The LMU of the present invention is implemented in the digital domain. A characterization of a digital circuitry is the capability to perform various arithmetic functions. This is used to automatically determine the required operations of arithmetic calculations. The logical operations are decided by single inputs from the content, ambient light, ambient temperature, and manual brightness settings. An advantage of performing the mixing in the digital domain versus the analog domain is that the result of the digital calculation results provides a unique result, whereas the analog mixing provides a non deterministic result that is affected by environmental conditions. Because of the logical operations, the new applied brightness value can be determined without use of a clock, therefore the only time delay that occurs is the propagation delay in the digital gates. Keeping the time lag between displaying a new frame and updating the new applied brightness value as small as possible results in minimum distortion of the displayed image.

The present invention has been described in terms of specific embodiments incorporating details to facilitate the understanding of the principles of construction and operation of the invention. Such references, herein, to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. An apparatus to control a brightness value applied to a display, the apparatus comprising:

a. an analog-to-digital converter configured to convert an analog ambient signal corresponding to one or more ambient characteristics to a digital ambient signal;

b. an ambient compensation module configured to calculate a first brightness value according to the digital ambient signal and a manual brightness setting;

c. a content compensation module configured to receive an input digital content signal, wherein the digital content signal comprises video frame data for a series of video frames including a frame brightness value corresponding to each frame, further wherein the content compensation module is further configured to calculate a second brightness value according to the first brightness value and the frame brightness value of a current frame; and d. a step generator configured to generate an applied brightness value, wherein the step generator includes a comparator to compare an applied brightness value from a previous cycle to the second brightness value of a current cycle calculated by the content compensation module, and a counter to increment or decrement the applied brightness value from the previous cycle according to the comparison, thereby generating the applied brightness value of the current cycle.

2. The apparatus of claim 1 wherein one of the one or more ambient characteristics includes an ambient light value, and the ambient compensation module comprises an ambient light compensation module, further wherein the analog-to-digital converter is further configured to convert an analog ambient light signal to a digital ambient light signal, and the ambient compensation module is configured to calculate the first brightness value according to the digital ambient light signal and the manual brightness setting.

3. The apparatus of claim 2 wherein one of the one or more ambient characteristics includes an ambient temperature value, and the ambient compensation module further comprises an ambient temperature compensation module, further wherein the analog-to-digital converter is further configured to convert an analog ambient temperature signal to a digital ambient temperature signal, and the ambient compensation module is configured to calculate the first brightness value according to the digital ambient temperature signal.

4. The apparatus of claim 3 wherein the ambient light compensation module is coupled to the analog-to-digital converter to receive the digital ambient light signal and is configured to output an intermediate first brightness value, and the ambient temperature compensation module is coupled to the analog-to-digital converter to receive the digital temperature signal and to the ambient light compensation module to receive the intermediate first brightness value, and the ambient temperature compensation module is configured to output the first brightness value.

5. The apparatus of claim 4 further comprising a step counter coupled to the ambient light compensation module, wherein the step counter is configured to increment or decrement the intermediate first brightness value before inputting to the ambient temperature compensation module.

6. The apparatus of claim 3 wherein the ambient temperature compensation module is coupled to the analog-to-digital converter to receive the digital temperature signal, and the ambient temperature compensation module is configured to output an intermediate first brightness value, further wherein the ambient light compensation module is coupled to the analog-to-digital converter to receive the digital ambient light signal and to the ambient temperature compensation module to receive the intermediate first brightness value, and the ambient light compensation module is configured to output the first brightness value.

7. The apparatus of claim 6 further comprising a step counter coupled to the ambient light compensation module, wherein the step counter is configured to increment or decrement the first brightness value before inputting to the content compensation module.

8. The apparatus of claim 1 wherein the frame brightness value defines a duty cycle, and the content compensation module is configured to multiply the first brightness value by the duty cycle to calculate the second brightness value.

9. The apparatus of claim 1 further comprising a display driver coupled to receive the applied brightness value from the step generator.

10. The apparatus of claim 1 wherein the apparatus comprises a mobile device.

11. An apparatus to control a brightness value applied to a display, the apparatus comprising:

a. an analog-to-digital converter configured to convert an analog ambient light signal to a digital ambient light signal and to convert an analog ambient temperature signal to a digital ambient temperature signal;

b. an ambient light compensation module coupled to the analog-to-digital converter, wherein the ambient light compensation module configured to calculate a first brightness value according to the digital ambient light signal and a manual brightness setting;

c. a step counter coupled to the ambient light compensation module, wherein the step counter is configured to increment or decrement the first brightness value, thereby outputting a second brightness value;

d. an ambient temperature compensation module coupled to the step counter and to the analog-to-digital converter, wherein the ambient temperature compensation module is configured to calculate a third brightness value according to the digital ambient temperature signal received from the analog-to-digital converter and the second brightness value received from the step counter;

e. a content compensation module configured to receive an input digital content signal, wherein the digital content signal comprises video frame data for a series of video frames including a frame brightness value corresponding to each frame, further wherein the content compensation module is further configured to calculate a fourth brightness value according to the third brightness value and the frame brightness value of a current frame; and f. a step generator configured to generate an applied brightness value of a current cycle, wherein the applied brightness value is generated by comparing an applied brightness value from a previous cycle to the fourth brightness value of the current cycle calculated by the content compensation module, and to increment or decrement the applied brightness value from the previous cycle according to the comparison, thereby generating the applied brightness value of the current cycle.

12. The apparatus of claim 11 wherein the frame brightness value defines a duty cycle, and the content compensation module is configured to multiply the first brightness value by the duty cycle to calculate the second brightness value.

13. The apparatus of claim 11 further comprising a display driver coupled to receive the applied brightness value from the step generator.

14. The apparatus of claim 11 wherein the apparatus comprises a mobile device.

15. A method of controlling a brightness value applied to a display, the method comprising:

a. converting an analog ambient signal corresponding to one or more ambient characteristics to a digital ambient signal;

b. calculating a first brightness value according to the digital ambient signal and a manual brightness setting;

c. receiving an input digital content signal, wherein the digital content signal comprises video frame data for a series of video frames including a frame brightness value corresponding to each frame;

d. calculating a second brightness value according to the first brightness value and the frame brightness value of a current frame;

e. comparing an applied brightness value from a previous cycle to the second brightness value calculated for a current cycle; and f. generating an applied brightness value by incrementing or decrementing the applied brightness value from the previous cycle according to the comparison.

16. The method of claim 15 wherein one of the one or more ambient characteristics includes an ambient light value, and the method further comprises converting an analog ambient light signal to a digital ambient light signal.

17. The method of claim 16 further comprising calculating the first brightness value according to the digital ambient light signal and the manual brightness setting.

18. The method of claim 17 wherein one of the one or more ambient characteristics includes an ambient temperature value, and the method further comprises converting an analog ambient temperature signal to a digital ambient temperature signal.

19. The method of claim 18 further comprising calculating the first brightness value according to the digital ambient temperature signal.

20. The method of claim 19 wherein calculating the first brightness value comprises first calculating an intermediate first brightness value according to the digital ambient light signal and the manual brightness setting, and then calculating the first brightness value according to the intermediate first brightness value and the digital ambient temperature signal.

21. The method of claim 20 further comprising incrementing or decrementing the intermediate first brightness value before calculating the first brightness value.

22. The method of claim 19 wherein calculating the first brightness value comprises first calculating an intermediate first brightness value according to the digital ambient temperature signal, and then calculating the first brightness value according to the intermediate first brightness value, the digital ambient temperature signal, and the manual brightness setting.

23. The method of claim 22 further comprising incrementing or decrementing the first brightness value before calculating the second brightness value.

24. The method of claim 15 wherein the frame brightness value defines a duty cycle, and the step of calculating the second brightness value comprises multiplying the first brightness value by the duty cycle.

25. The method of claim 15 further comprising generating a display driving signal according to the applied brightness value.

* * * * *